US005472514A

United States Patent [19]

Grimsley

[11] Patent Number: 5,472,514

[45] Date of Patent: Dec. 5, 1995

[54] DUCT CLEANING METHOD

[75] Inventor: Arvid K. Grimsley, Greenwich, Conn.

[73] Assignee: Goodway Technologies Corporation, Stamford, Conn.

[21] Appl. No.: 258,414

[22] Filed: Jun. 10, 1994

Related U.S. Application Data

[63] Continuation of Ser. No. 865,326, Apr. 8, 1992, abandoned.

[51] Int. Cl.[6] ..... B08B 1/04; B08B 5/04; B08B 9/04

[52] U.S. Cl. ..... 134/8; 134/21; 134/22.11; 15/314; 15/383; 15/395

[58] Field of Search ..... 134/8, 21, 22.1, 134/22.11, 24; 15/319, 383, 395

[56] References Cited

U.S. PATENT DOCUMENTS

| | | | |
|---|---|---|---|
| 2,976,191 | 3/1961 | Weston | 134/24 |
| 3,485,671 | 12/1969 | Stephens | 134/8 X |
| 4,025,360 | 5/1977 | Horne et al. | 134/24 |
| 4,141,753 | 2/1979 | Greed | 134/24 X |
| 4,792,363 | 12/1988 | Franklin, Jr. et al. | 134/21 X |
| 5,003,998 | 4/1991 | Collett | 134/24 X |

FOREIGN PATENT DOCUMENTS 002565 6/1985 WIPO .

*Primary Examiner*—David A. Simmons
*Assistant Examiner*—Saeed Chaudhry
*Attorney, Agent, or Firm*—Patrick J. Walsh

[57] ABSTRACT

A method and apparatus for cleaning ducts such as used in HVAC systems includes as part of the apparatus a propeller having pitched, flexible blades for rotatably engaging the interior duct surface for dislodging soot and propelling a cloud of soot along the duct to an evacuation point. The method includes establishing a temporary block in the duct, moving the propeller along the duct for dislodging soot and generation a dust cloud, and evacuating the duct by drawing the soot cloud created by the propeller.

4 Claims, 2 Drawing Sheets

DUCT CLEANING METHOD

This is a continuation of application Ser. No. 865,326 filed Apr. 8, 1992, now abandoned.

BACKGROUND OF THE INVENTION

The present invention relates to cleaning ducts, for example ducts forming part of heating, ventilation, and air conditioning (HVAC) systems.

In a typical commercial or residential structure, a HVAC system includes heating and air conditioning units located in a machinery room with ventilating ducts extending to individual spaces throughout the structure. The HVAC system includes air filters to remove dirt entrained in the air stream entering and circulating throughout the system. Nonetheless, dirt and soot do enter the system even if only in small quantities and in time accumulates on the interior surfaces of the ventilating ducts requiring periodic cleaning.

The present invention provides a new and improved method and apparatus for duct cleaning and overcomes the limitations of existing techniques.

SUMMARY OF THE INVENTION

According to the invention, HVAC duct installations including permanent systems as well as temporary installations such as flexible ducting are cleaned of dirt and soot accumulations along their interior surfaces by means of a rotating propeller having a series of flexible, pitched blades fitted to a hub and having a circular fan area with a diameter greater than the actual diameter of cylindrical ducts and greater than the major dimension of square and rectangular ducts. The rotary propeller blades are formed of suitable material such as woven nylon and are secured to the hub at a predetermined pitch so that when rotated within a duct, the blade tips engage the interior duct surface and dislodge soot and dirt. The pitched blades also create a downstream air flow within the duct in the vicinity of the propeller which entrains dislodged dirt and creates a cloud of dirt moving through the duct ahead of the rotating propeller. According to a method aspect of the invention, a vacuum source is applied to the duct downstream of the operating propeller for evacuating the duct and maintaining an air flow which enables the cloud of dirt to remain air borne until it leaves the duct through the vacuum source.

The propeller is fitted to and powered by a suitable rotary drive such as a flexible drive cable which is fed by an operator down into the duct.

In accordance with the method aspect of the invention, a section of ducting is prepared for cleaning by inserting a blocking device into the duct for establishing or defining a duct section to be cleaned and for blocking flow of air downstream beyond the block. Ordinarily the block is established at a convenient location in the duct system as for example just downstream of an access or inspection opening forming part of the duct. The block itself is preferably an inflatable ball or sphere which is easy to install and remove and which when inflated acts as a barrier to flow of a cloud of soot beyond the block. A source of vacuum is then applied to the isolated duct section by means of a special fitting secured to the inspection opening. Next, the cleaning propeller enters the isolated duct through a convenient opening such a ceiling air outlet upstream of the block and begins dislodging interior soot and dirt and propelling a cloud of dust down the duct. The vacuum source evacuates the duct drawing the cloud of dust from the duct until the propeller reaches the block. This basic operation is repeated until the entire duct system is cleaned of soot and dirt.

Flexible ducting is widely used in HVAC systems because of its low cost and ease of installation. Typically, flexible ducting consists of an outer plastic layer, an inner layer of insulation such as fiberglass, an inner plastic liner defining the inner surface of the duct through with conditioning air passes and an inner spiral spring engaging the inner surface of the duct and maintaining the cylindrical shape of the flexible duct. The propeller cleaning apparatus and method of the invention are particularly suited to cleaning such flexible ducting. The rotating propeller blades being themselves flexible readily conform to the soft inner liner of the duct as they wipe soot and dirt from its inner surface. Additionally the propeller tips do not pierce or otherwise damage the the integrity of the liner. The vacuum source is applied to an end of the flexible duct to evacuate the duct and collect the cloud of dirt generated by the propeller.

The invention may be practiced in several ways, the preferred embodiment being a dedicated vacuum cleaner capable of evacuating lengthy sections of HVAC duct systems and of sufficient capacity for collecting the required volume of soot, together with a cleaning propeller and its driving mechanism, a versatile blocking device, and the necessary fittings for connecting the vacuum source to fixed and flexible duct systems.

OBJECTS OF THE INVENTION

It is an object of the invention to provide a method and apparatus for cleaning ducts, especially HVAC system ducts.

It is an object of the invention to provide an apparatus for dislodging soot from HVAC ducts, entraining the soot in an moving air cloud, and evacuating the duct to remove the soot.

It is a further object of the invention to provide a duct cleaning apparatus including a rotating propeller having flexible blades for dislodging soot from a duct and for generating an air flow for entraining the soot enabling removal of the soot from the duct by means of a vacuum cleaner.

It is a further object of the invention to provide a method and apparatus for cleaning rigid as well as flexible ducts.

It is a further object of the invention to provide a method for cleaning ducts in which a section of duct is isolated by blocking air flow beyond the isolated section, dislodging and propelling soot downstream toward the block location, and evacuating the duct at the block location.

It is a further object of the invention to provide a method and apparatus for cleaning HVAC systems in which cleaning is performed section by section of the system without the need to secure the system.

It is another object of the invention to provide a method and apparatus which is relatively quiet so as not to unduly disturb or annoy occupants of a building undergoing HVAC system cleaning.

Other and further objects of the invention will occur to those skilled in the art with an understanding of the following detailed description of the invention or upon employment of the invention in practice.

DESCRIPTION OF THE DRAWING

A preferred embodiment of the invention has been chosen for purposes of illustrating the construction and operation of the and is shown in the accompanying drawing in which.

DETAILED DESCRIPTION OF THE INVENTION

Figures 1, 2, 3:
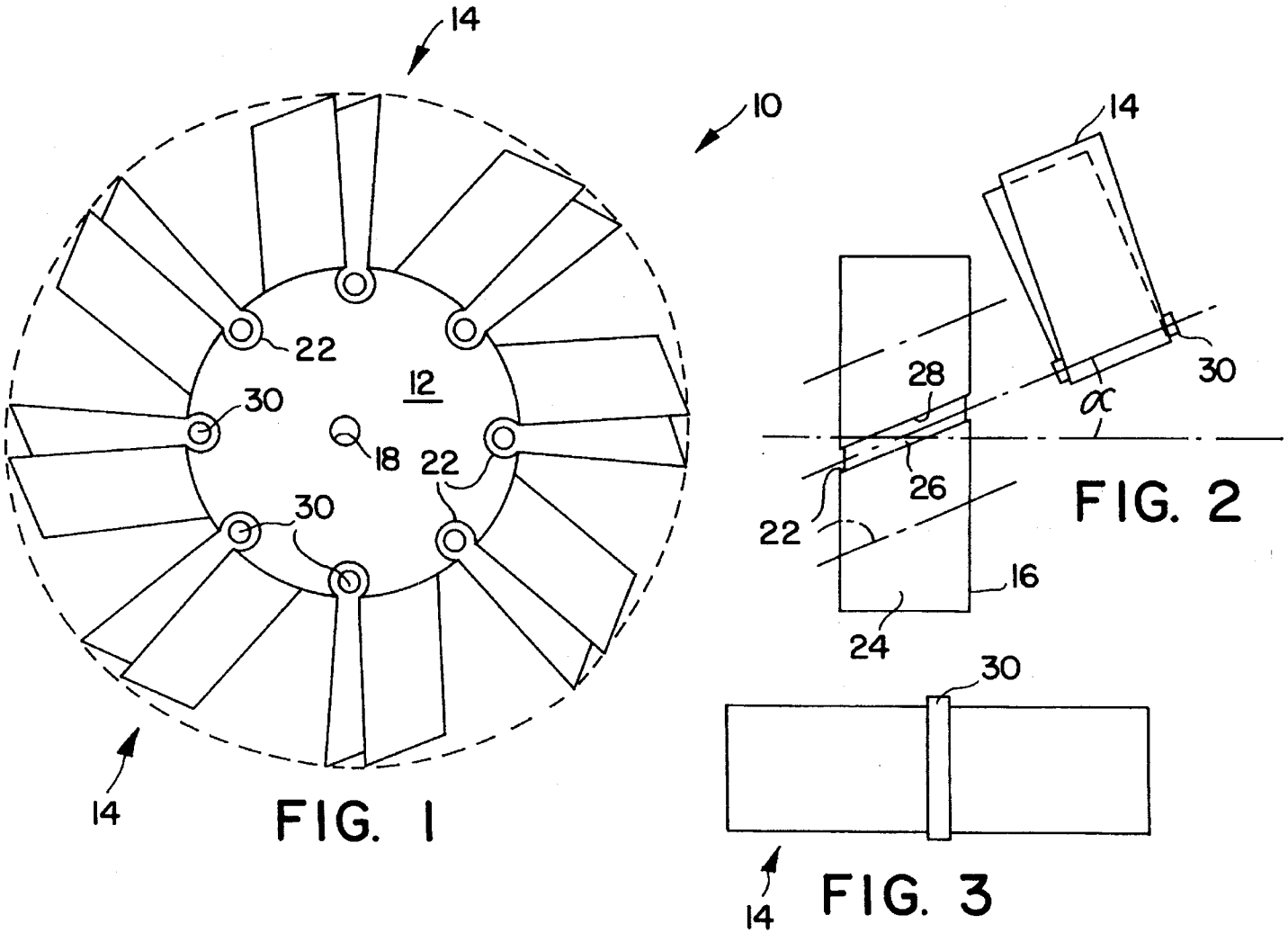
FIG. 1 is a front elevation view of a propeller forming part of the apparatus of the present invention.
FIGS. 2 and 3 illustrate assembly details of the propeller of FIG. 1.

Referring to FIGS. 1—3 of the drawing, the apparatus of the invention includes a propeller 10 having a hub 12 and blades 14.

In a preferred form, the hub may be fabricated of lightweight material such as aluminum or plastic and is preferably a cylindrical block 16 with an axial bore 18 for connection to a rotary cable 20 and with peripheral channels 22 equally spaced along the hub circumference 24 for receiving the propeller blades. The peripheral channels are formed at a predetermined angle or pitch with respect to the axis of rotation of the hub. Channel pitch determines blade pitch. The channels as shown in FIG. 3 are preferably cylindrical with a portion of each cylinder bore 26 intersecting the hub circumference to define channel openings 28 for receiving propeller blades.

The propeller blades 14 are preferably formed of a length of strip material such as woven nylon which is flexible, does not inflict damage or wear on either flexible or sheetmetal ducting and which produces relatively low noise levels particularly when cleaning sheetmetal ducts. The propeller strips are folded about a mounting shaft 30 and are inserted into the peripheral channels and there project radially from the hub in the form of propeller blades 14. The propeller, when rotating, defines a fan area encompassing the internal surfaces of a HVAC duct including circular, square, or rectangular ductwork.

The hub is fitted to a rotatable, flexible cable 20 which rotates the propeller and moves the propeller along the length of duct being cleaned. The flexible cable includes an inner wound steel rotary drive shaft 32 and outer protective casing 34 normally handled by an operator in deploying the propeller. Suitable fittings 36 secure the rotary portion of the cable to the propeller hub.

Figure 5:
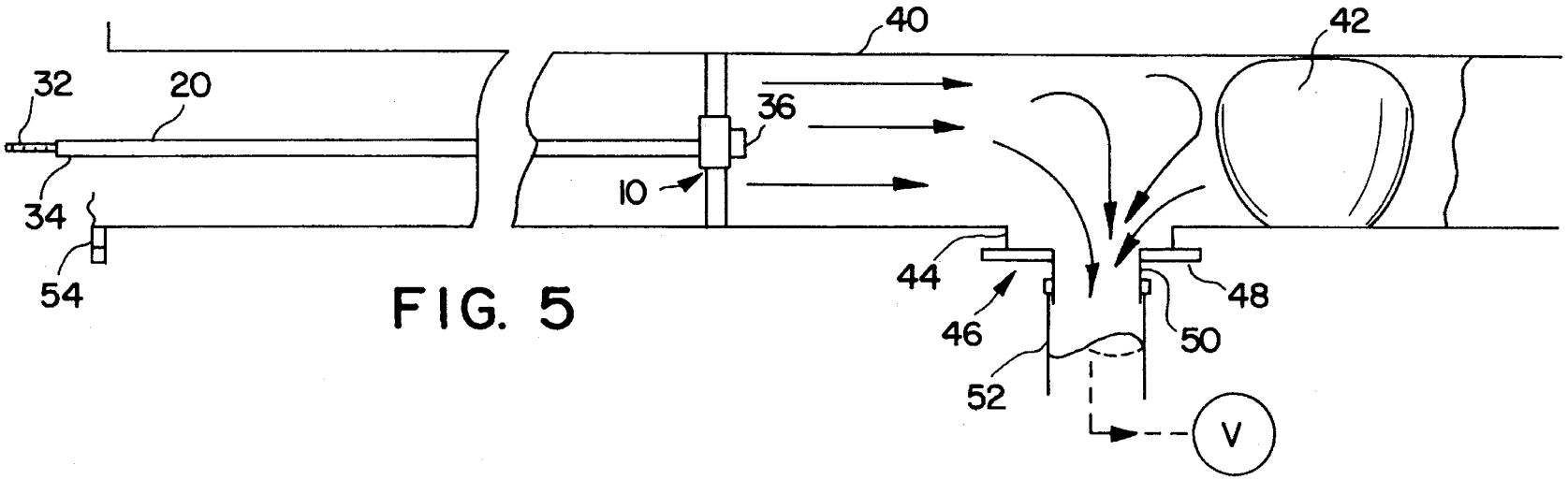
FIG. 5 is a schematic layout of the apparatus of the invention in the process of cleaning a HVAC system.

In accordance with a method aspect of the invention, a section of ducting 40 as shown in FIG. 5 is prepared for cleaning by inserting a blocking device 42 into the duct for establishing or isolating the duct section for cleaning. The block confines the flow of dislodged soot to the isolated section and enables evacuation of soot from the section. Ordinarily the block is established at a convenient location in the duct system as for example just downstream of an access or inspection opening 44 forming part of the duct. The block itself is preferably an inflatable ball or sphere which is easy to install and remove and which when inflated acts as a barrier to flow of a cloud of soot beyond the block. A source of vacuum is then applied to the isolated duct section by means of a special fitting 46 secured to the inspection opening. The fitting includes a cover plate 48 and nipple 50 for mounting over the inspection opening and for attachment to a vacuum hose 52. Next, the cleaning propeller enters the isolated section of duct through a convenient opening such a ceiling or wall grille 54 upstream of the block. The propeller is fed into the duct at the end of the rotary cable and begins rotating with the tips of the propeller blades engaging and dislodging soot and dirt from the duct interior. The propeller generates an air flow downstream ahead of the pitched propeller blades thereby entraining and propelling a cloud of soot and dust down through the duct interior toward the block. The vacuum source V evacuates the isolated section of duct drawing the cloud of dust from the duct through the inspection opening until the propeller reaches the block. This basic operation is repeated until the entire duct system is cleaned of soot and dirt.

As described the propeller may be described as "pushing" the cloud of air and soot ahead of the propeller and away from the operator as it moves forward through a duct. By reversing the direction of rotation of the rotary cable, an air flow to the rear of the propeller is generated so that the cloud of dirt can be "pulled" backward through the duct toward the operator. This aspect of the invention allows considerable latitude in locating the system block with respect to the vacuum source. For example, the block may be located some distance along a duct beyond an inspection opening enabling the operator to "push" a cloud of soot ahead of the propeller from access opening to the evacuation point, and, after reversing propeller pitch, to "pull" a cloud of dust and soot back through the duct from the block point to the evacuation point.

Figure 4:
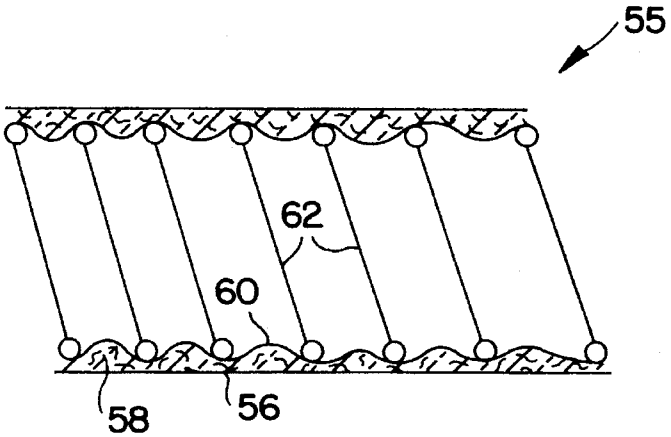
FIG. 4 is a schematic view of a flexible duct for cleaning by the present invention.

The propeller cleaning apparatus and method of the invention are particularly suited to cleaning flexible ducting used in HVAC systems. Such ducts 55 (FIG. 4) include an outer plastic layer 56, an inner layer of insulation 58 such as fiberglass, an inner plastic liner 60 defining the inner surface of the duct through with conditioning air passes and an inner spiral spring 62 engaging the inner surface of the duct and maintaining the cylindrical shape of the flexible duct. The rotating propeller blades being themselves flexible readily conform to the soft inner liner of the duct as they wipe soot and dirt from its inner surface. Additionally the propeller tips do not pierce or otherwise damage the the integrity of the liner. The vacuum source is applied to an end of the flexible duct to evacuate the duct and collect the cloud of dirt generated by the propeller.

The invention provides an effective system for methodically and effectively removing soot and dirt from HVAC equipment with minimal need for removing system components, minimal disruption of building routine, while entirely confining the dislodged soot within removal equipment. Operation of the system is within the capability of building maintenance personnel for routine maintenance of HVAC equipment.

I claim:

1. A method of cleaning ducts by dislodging dirt from the interior surface thereof comprising the steps of preparing a section of duct for cleaning by inserting a blocking device into the duct downstream of an access or an inspection opening for isolating the duct section and confining dislodged dirt to the isolated section, inserting a propeller having a plurality of pitched blades into the isolated section of duct through a duct opening upstream of said access or inspection opening, feeding the propeller into the duct at the end of a rotary flexible cable, rotating the propeller by means of the rotary cable with the tips of the propeller blades in engagement with the interior surface of the duct and dislodge dirt therefrom, generating an air flow by means of the pitched rotating propeller blades with the air flow moving downstream ahead of the pitched propeller blades thereby entraining and propelling a cloud of dislodged dirt through the duct interior toward the block, and applying a source of vacuum to the isolated duct section for evacuating dirt from the isolated duct section at said access or inspection opening.

2. The method of claim 1 including the step of inflaring the blocking device.

3. A method of claim 1 in which the propeller pitch is forward and the air cloud is pushed by the propeller along the duct.

4. A method of claim 1 in which the propeller pitch is reverse and the air cloud is pulled by the propeller along the duct.

* * * * *